US006199382B1

(12) United States Patent
Walter et al.

(10) Patent No.: US 6,199,382 B1
(45) Date of Patent: Mar. 13, 2001

(54) DYNAMIC CONDENSATE SYSTEM

(75) Inventors: Jeremy L. Walter; Robert W. Royer; Michael E. Crouse, all of State College, PA (US)

(73) Assignee: Penn State Research Foundation, University Park, PA (US)

( * ) Notice: Subject to any disclaimer, the term of this patent is extended or adjusted under 35 U.S.C. 154(b) by 0 days.

(21) Appl. No.: 09/447,612

(22) Filed: Nov. 23, 1999

Related U.S. Application Data

(60) Provisional application No. 60/109,976, filed on Nov. 25, 1998.

(51) Int. Cl.[7] ..... F01K 13/02
(52) U.S. Cl. ..... 60/646; 60/657
(58) Field of Search ..... 60/643, 646, 657

(56) References Cited

U.S. PATENT DOCUMENTS

| | | | | |
|---|---|---|---|---|
| 3,769,789 | * | 11/1973 | Niggermann | 60/36 |
| 4,510,755 | * | 4/1985 | Gartmann et al. | 60/657 |
| 4,818,475 | * | 4/1989 | Gluntz et al. | 60/658 |
| 5,343,705 | * | 9/1994 | Athey et al. | 60/646 |

* cited by examiner

*Primary Examiner*—Hoang Nguyen
(74) *Attorney, Agent, or Firm*—Thomas J. Monahan

(57) ABSTRACT

The present invention is a dynamic condensate system which can replace the hotwell designs currently available. The dynamic condensate system enhances the performance of a compact closed Rankine-cycle or similar engine using a single small-volume apparatus which actively separates noncondensables from the subcooled condensate; lowers condenser pressure; boosts feed-pump inlet pressure; allows the hotwell volume to remain at ambient pressure; and eliminates lateral acceleration effects on the engine. The dynamic condensate system includes a liquid ring pumping element and a side-branch hotwell. There is an inlet to the liquid ring pumping element from a condenser of the engine for receiving liquid and vapor flow. An outlet from the liquid ring pumping element provides a flow path for liquid from the dynamic condensate system to a feed pump of the engine. A discharge port from the liquid ring pumping element provides a flow path to the side-branch hotwell to remove vapor from the liquid and vapor flow from the condenser. Finally, there is an output from the side-branch hotwell connected to the inlet to the liquid ring pumping element for reintroducing remaining liquid captured during removal of the vapor.

27 Claims, 4 Drawing Sheets

DYNAMIC CONDENSATE SYSTEM

This application claims priority to U.S. Provisional Application Ser. No. 60/109,976 filed Nov. 25, 1998, which is herein incorporated by reference.

GOVERNMENT SPONSORSHIP

This invention was made with governmental support under Grant No. N00039-92-C-0100 awarded by the Department of the Navy. The Government has certain rights in the invention.

BACKGROUND

The classic Rankine cycle heat engine is illustrated schematically in FIG. 1. Most utility electric companies and many naval propulsion systems produce power from modified Rankine-cycle heat engines, usually using water as the working fluid. Compact versions of Rankine-cycle turbine engines have been built and demonstrated. Such systems are reliable, high-power-density power sources, and have been applied to specialized propulsion systems for undersea high-speed vehicles such as torpedoes.

In all practical engines with condensers, a fraction of the flow entering the condenser will be noncondensable gas, especially during the rapid start-up and early stages of operation of a compact engine. Most condensers include a subcooler before the high-pressure feed pump. The subcooler can be part of the condenser unit or a separate unit between the condenser and high-pressure feed pump. For simplicity, it is assumed that the condenser exit includes a subcooler before the condenser exit. In the case of compact once-through condensers, non-condensable gas is carried as bubbles along with the liquid to a condenser exit. Bubbles can interfere with production of well-controlled, steady power from the engine by causing the supply of liquid to a high pressure feed pump inlet to be unsteady or interrupted. Some provision needs to be made, therefore, to eliminate the noncondensable gases from the condensate flow before the working fluid enters the high-pressure feed pump.

In normal practice, a volume is placed in series between the condenser exit and the high-pressure pump inlet through which the working fluid flows. This volume is called a "hotwell" and utilizes gravity to form a free surface and bubble buoyancy to carry bubbles up to the free surface where they escape. The bubble-free inlet flow for the high-pressure pump is then taken from near the bottom of the hotwell. The thermodynamic state in the typical hotwell is near the boiling point of the liquid, and often special boost pumps are required to prevent cavitation in the high pressure feed pump. In addition to its function in bubble separation, the hotwell also serves as a reservoir for changes in working-fluid inventory during power-level and environmental changes and is often augmented with make-up fluid as necessary. The problem is that a gravity-driven liquid/gas separation process in the hotwell has proven to be inadequate for some propulsion applications.

The thermal efficiency of the Rankine engine is also affected by condensate handling and current hotwell design. The cycle efficiency is improved significantly by lowering condenser pressure. Lower condenser pressures reduce the backpressure at the turbine and lower the cycle heat-rejection temperature. Normal practice for lowering condenser pressure below ambient is to add a vacuum pump or ejector to extract accumulating noncondensable gas from the volume above the liquid surface in the hotwell, effectively lowering the pressure in the entire low-pressure portion of the working-fluid loop. The resulting low pressure in the hotwell expands the bubbles in the liquid, aggravating the compact-engine hotwell impact by entraining liquid in the vapor flow to the vacuum pump. Because of the local thermodynamic state, the vapor removed by the vacuum pump or ejector also contains a significant fraction of evaporated working fluid, continuously reducing the working-fluid inventory. Also, the lower pressure increases the risk of feed pump cavitation by lowering the net-positive-suction-head (NPSH) at the pump inlet, making the addition of a boost pump necessary.

In the case of a maneuverable vehicle using an engine with a hotwell, the lateral accelerations of the vehicle during a high-speed turn can shift the effective "g" vector to nearly horizontal axes. This causes the location and orientation of the free surface to be both variable and unpredictable in a maneuverable vehicle. In addition, some highly maneuverable vehicles require compact systems to meet severe volume constraints. As hotwell volumes are reduced and working fluid flowrates remain high, capillary and momentum forces in the high-rate flows overcome the ability of gravity forces to remove bubbles. There is, therefore, a minimum hotwell volume below which gravity-driven performance becomes marginal or unacceptable in even non-maneuvering conditions.

The object of the present invention is to improve the performance of compact, closed Rankine-cycle engines as well as other closed-cycle engines which pump condensate such as those used for propulsion of vehicles.

SUMMARY OF THE INVENTION

The present invention is a dynamic condensate system for a gas turbine engine. The dynamic condensate system includes a liquid ring pumping element and a side-branch hotwell. There is an inlet to the liquid ring pumping element from a condenser of the engine for receiving liquid and vapor flow. An outlet from the liquid ring pumping element provides a flow path for liquid from the dynamic condensate system to a feed pump of the engine. A discharge port from the liquid ring pumping element provides a flow path to the side-branch hotwell to remove vapor from the liquid and vapor flow from the condenser. Finally, there is an output from the side-branch hotwell connected to the inlet to the liquid ring pumping element for reintroducing remaining liquid captured during removal of the vapor.

DETAIL DESCRIPTION OF THE INVENTION

The present invention is a dynamic condensate system which can replace the hotwell designs currently available. The dynamic condensate system enhances the performance of a compact closed Rankine-cycle or similar engine using a single small-volume apparatus which actively separates noncondensables from the subcooled condensate; lowers condenser pressure; boosts feed-pump inlet pressure; allows the hotwell volume to remain at ambient pressure; and eliminates lateral acceleration effects on the engine.

Figure 1:
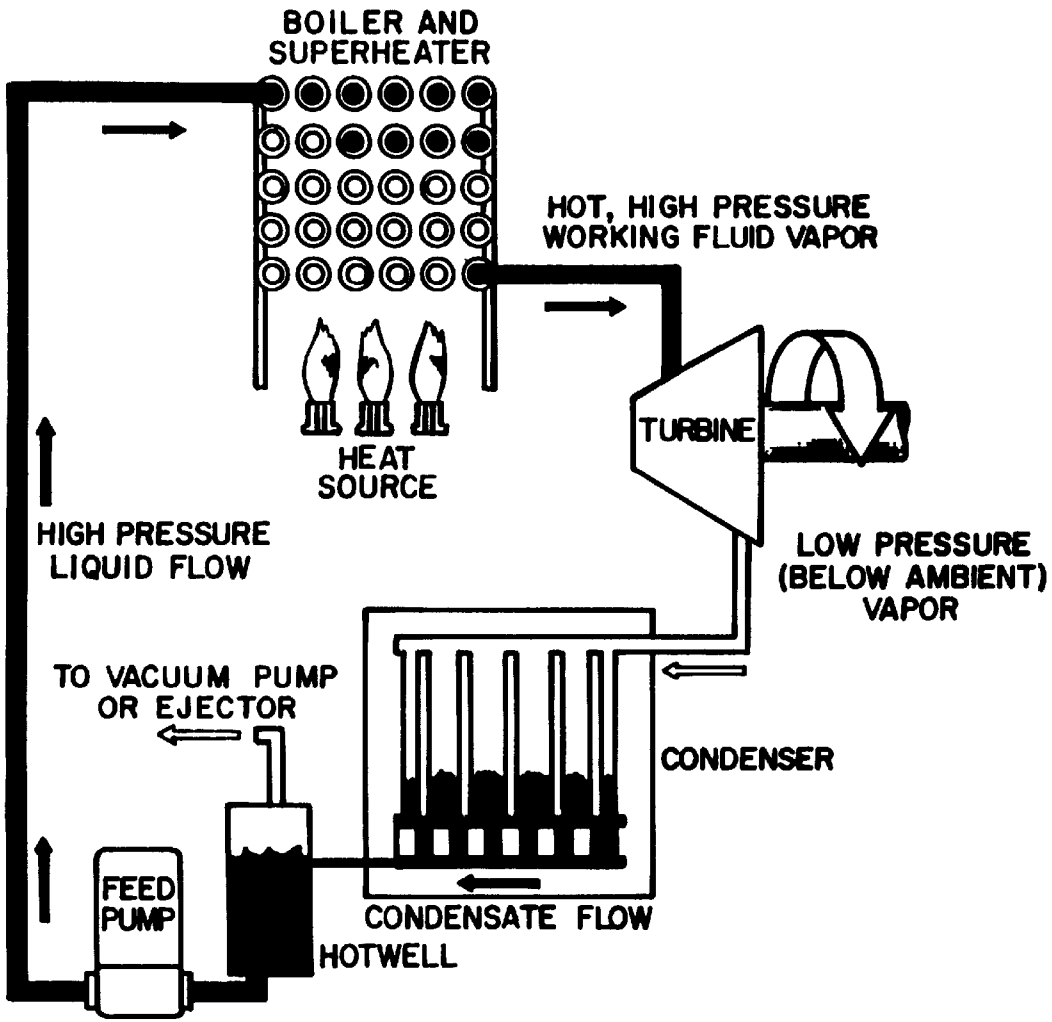
FIG. 1 is a schematic of a classic Rankine-Cycle Heat Engine.
Figure 2:
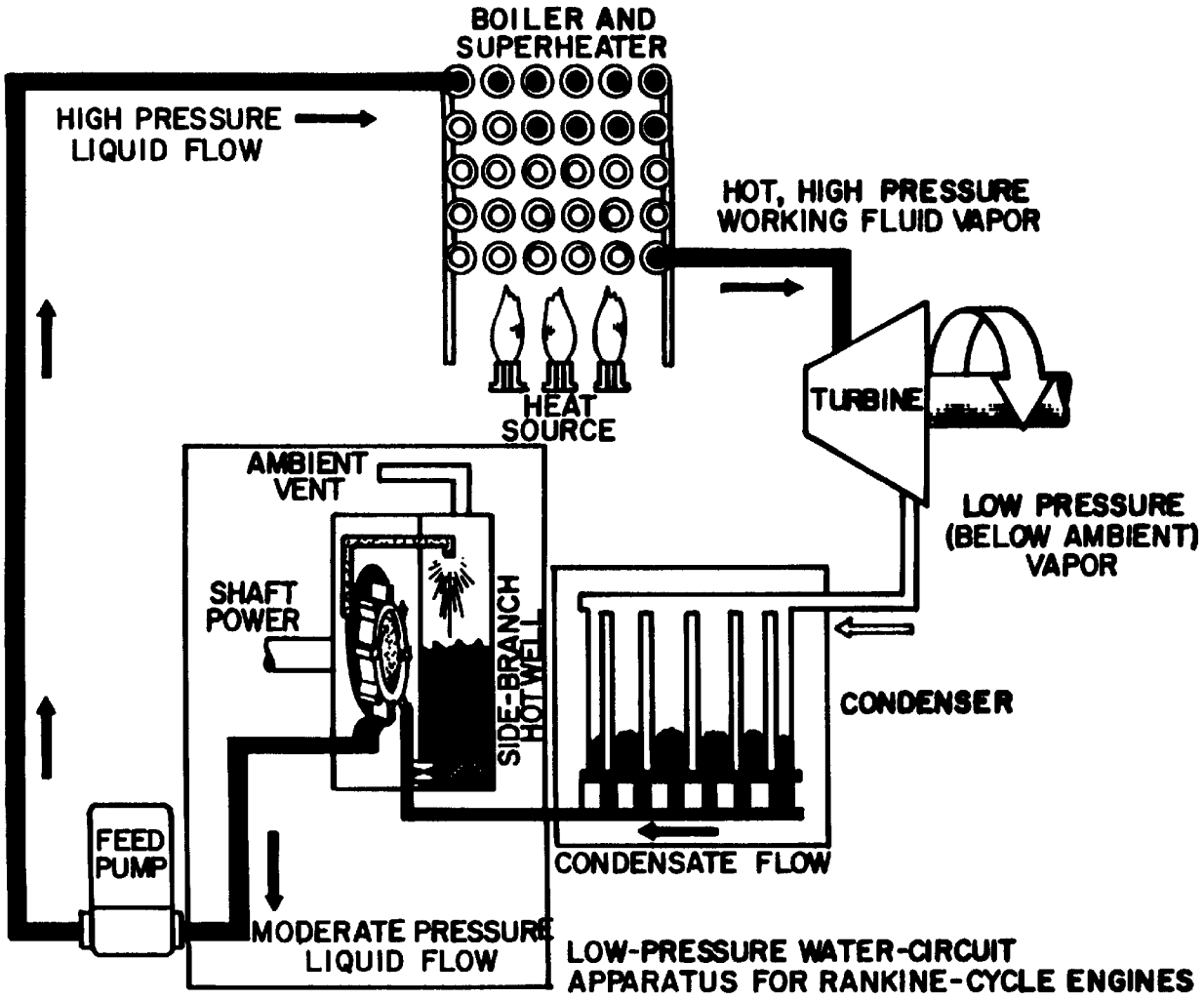
FIG. 2 is a schematic of a modified Rankine-Cycle Heat Engine including the addition of a dynamic condensate system according to the present invention.
Figure 3:
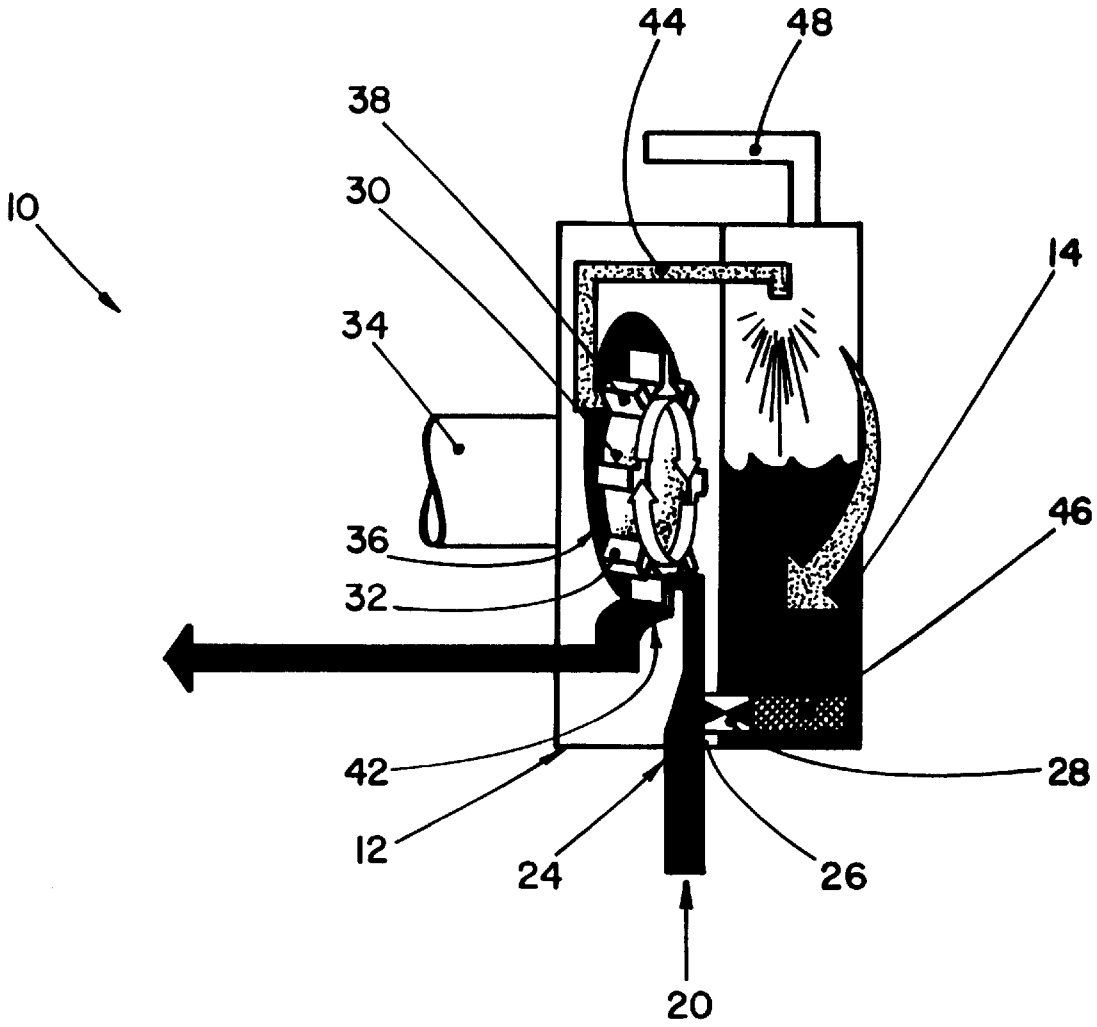
FIG. 3 is a schematic of the dynamic condensate system according to the present invention.

A schematic arrangement of a modified Rankine cycle incorporating the dynamic condensate system is illustrated in FIG. 2. The current hotwells normally placed directly in the flow path is replaced with the dynamic condensate system which includes a hotwell in a side-branch configuration. The components of the dynamic condensate system 10 are shown in FIG. 3. The dynamic condensate system 10 includes a liquid-ring pumping element 12 and a side branch hotwell 14. The dynamic condensate system 10 is placed at a condenser exit 20 of a Rankine cycle engine condenser. The liquid-ring pumping element 12 includes an inlet flow path from two parallel sources. The first source 24 being unrestricted from the condenser exit 20 and the second source 26 being restricted by a resistive flow element 28 from the bottom of the side branch hotwell 14. The resistive flow element 28 can be as simple as an orifice.

Figure 4:
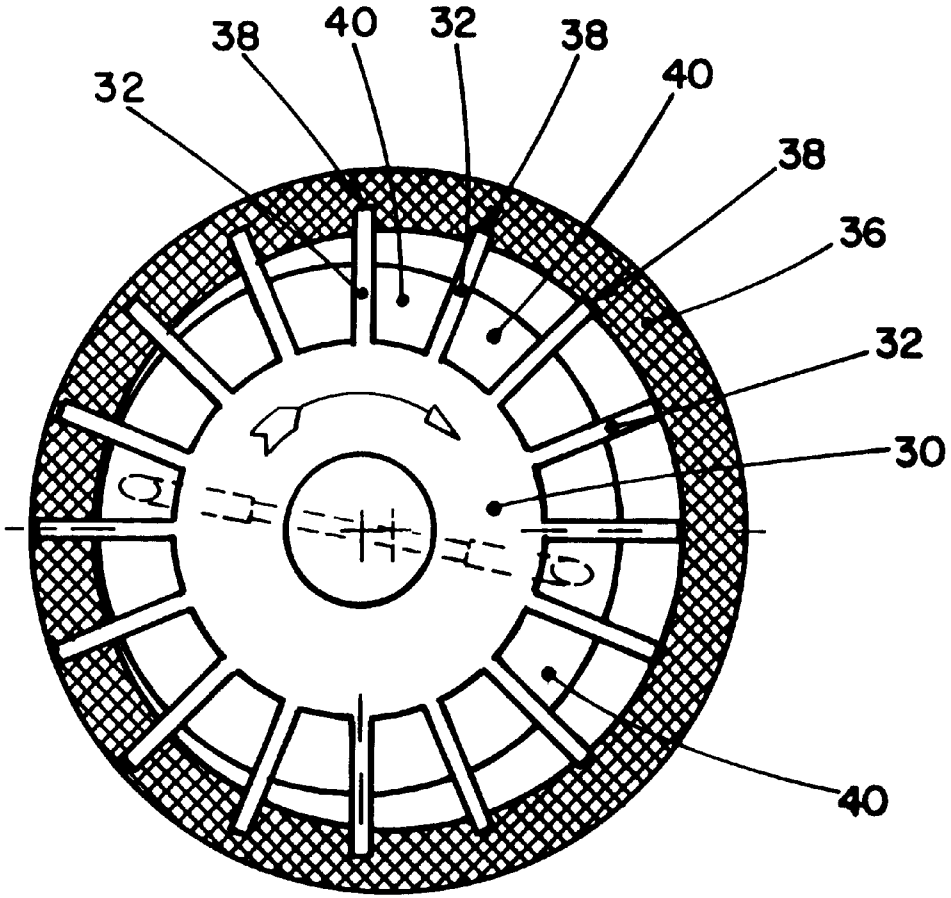
FIG. 4 is a perspective view of an impeller according to the present invention.

The liquid-ring pumping element 12 includes a rotating impeller 30 having vanes 32 and is driven by an output shaft 34 of the engine. The rotation of the impeller 30 establishes a rotating mass of liquid condensate referred to as a liquid ring 36. The impeller vanes 32 each have an outside tip 38, as shown in FIG. 4. Also, there is a web 40 between each vane 32. The liquid ring 36 seals the vane tips 38, allowing a volume enclosed by two vanes 32 to act independently from the volume between the next pair of vanes 32. The liquid ring 36 circulates in a path eccentric with respect to the impeller 30. Such eccentricity produces a pumping action known to be effective in compressing rarefied gases. The high centrifugal forces stratify the liquid and vapor along the circulation path, with the liquid on the periphery and the vapor at the core of the impeller 30. The pumping action of the liquid ring 36 is used to extract condensate from the condenser, reduce the condenser pressure, and draw excess flow from the side-branch hotwell 14. The liquid-ring pumping element 12 is also includes two discharge paths, one taken tangentially from the outer edge 42 of the liquid ring 36 to feed liquid to the inlet of the high-pressure feed pump, and the other from a discharge port 44 at the core of the liquid ring pumping element 12 to discharge vapor and excess liquid into the side-branch hotwell 14. The centrifugal action of the liquid ring 36 efficiently stratifies an incoming mixture of liquid and vapor discharged from the condenser such that all flow to the inlet of the high-pressure feed pump is liquid with a significant boost in pressure. The webs 40 of the impeller 30 aid in the separation of the vapor and liquid. This is effected by having the inlet flow path to the liquid ring pumping element 12 on one side of the webs 40, while having the discharge port 44 on the other side of the webs 40. Whereby, the centrifugal action forces the vapor from the inlet side of the web 40 to the other side of the web 40 having the discharge port 44.

The excess liquid flow is recirculated through the side-branch hotwell 14 and directed to impinge on a capillary bubble screen 46 of a fine-mesh hydrophilic fiber material. The capillary bubble screen 46 acts as a gas filter means. Capillary forces in the interstitial spaces of the capillary bubble screen 46 prevent vapor from flowing through the screen 46, but allow liquid to pass through freely. Vapor bubbles in the side branch hotwell 14 are blocked from returning to the liquid ring pumping element 12 by the capillary effects of the capillary screen 46. Hotwell pressure remains at ambient by means of a baffled vent port 48. The condenser pressure, which is below ambient, is regulated by a parametric design involving the geometrically-determined flow capacity of the liquid-ring pumping element 12, the required flowrate of the engine, and the resistance of the resistive flow element 28. Such flow resistance can be fixed or variable by making the resistive flow element 28 adjustable.

Testing of the dynamic condensate system 10 showed the centripetal acceleration of the liquid ring ranged from 300 to 2000 times that of gravity (g's). The turnrates of high-speed undersea vehicles create lateral accelerations that are less than 10 g's and usually less than 5 g's. Therefore, the superposition of the much smaller turn accelerations of such underwater vehicles have no effect on the performance of the liquid-ring pumping element 12. Tests have shown that the flow from the condensate return will feed directly to the high-pressure feed pump, even if excess flow from the side-branch hotwell 14 is intermittent. Although the free surface in the side-branch hotwell 14 is affected by lateral accelerations, the capillary forces on the fine-mesh hydrophilic surface prevent vapor ingestion from the side branch hotwell 14 during the turn. Extraction of liquid through any immersed portion of the fine-mesh surface is maintained by the hydrophilic properties of the material. The advantages of the dynamic condensate system 10 are the there is no dependency on gravity to stratify and separate liquid condensate from noncondensable gases. Condenser pressure is lowered directly, without a vapor vacuum pump and without lowering hotwell pressure. The bubbles present in the hotwell condensate are therefore not expanded, and no working fluid mist or vapors are being removed by the action of a vacuum pump, a known problem in compact Rankine-cycle engines. A pressure boost without the addition of a boost pump is provided to the high-pressure feed pump as an integral part of the separation and vacuum functions.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

We claim:

1. A dynamic condensate system comprising:

a liquid ring pumping element having a center;

a side-branch hotwell;

an inlet to said liquid ring pumping element;

an outlet from said liquid ring pumping element providing a flow path from said dynamic condensate system;

a discharge port from said liquid ring pumping element providing a flow path to said side-branch hotwell; and an output from said side-branch hotwell connected to said inlet to said liquid ring pumping element.

2. The dynamic condensate system of claim 1, wherein said liquid ring pumping element includes an impeller, said impeller having a plurality of vanes.

3. The dynamic condensate system of claim 2, wherein said impeller includes a web between each set of coinciding vanes of said plurality of vanes.

4. The dynamic condensate system of claim 1, further including a shaft to power said liquid ring pumping element.

5. The dynamic condensate system of claim 2, wherein said discharge port is positioned near said center of said liquid ring pumping element.

6. The dynamic condensate system of claim 2, wherein said vanes have tips and said outlet from said liquid ring pumping element is positioned near said tips.

7. The dynamic condensate system of claim 1, wherein said side-branch hotwell includes a vent to regulate internal pressure of said side-branch hotwell.

8. The dynamic condensate system of claim 1, further including a gas filter means positioned before said output from said side-branch hotwell to prevent the passage of gases as liquid flow through said output from said side-branch hotwell.

9. The dynamic condensate system of claim 8, wherein said gas filter means is a capillary bubble screen.

10. The dynamic condensate system of claim 9, wherein said capillary bubble screen is a fine-mesh hydrophilic fiber material.

11. The dynamic condensate system of claim 1, further including a resistive flow element before said output from said side-branch hotwell to provide resistance to liquid flow entering said inlet to said liquid ring pumping element.

12. The dynamic condensate system of claim 11, wherein said resistive flow element is an orifice.

13. A turbine engine comprising:

a means to heat a working fluid;

a turbine;

a condenser;

a feed pump; and a dynamic condensate system comprising a liquid ring pumping element having a center; a side-branch hotwell; an inlet to said liquid ring pumping element from said condenser; an outlet from said liquid ring pumping element providing a flow path from said dynamic condensate system to said feed pump; a discharge port from said liquid ring pumping element providing a flow path to said side-branch hotwell; and an output from said side-branch hotwell connected to said inlet to said liquid ring pumping element.

14. The turbine engine of claim 13, wherein said liquid ring pumping element includes an impeller, said impeller having a plurality of vanes.

15. The turbine engine of claim 14, wherein said impeller includes a web between each set of coinciding vanes of said plurality of vanes.

16. The turbine engine of claim 13, further including a shaft to power said liquid ring pumping element.

17. The turbine engine of claim 14, wherein said discharge port is positioned near said center of said liquid ring pumping element.

18. The turbine engine of claim 14, wherein said vanes have tips and said outlet from said liquid ring pumping element is positioned near said tips.

19. The turbine engine of claim 13, wherein said side-branch hotwell includes a vent to regulate internal pressure of said side-branch hotwell.

20. The turbine engine of claim 13, further including a gas filter means positioned before said output from said side-branch hotwell to prevent the passage of gases as liquid flow through said output from said side-branch hotwell.

21. The turbine engine of claim 20, wherein said gas filter means is a capillary bubble screen.

22. The turbine engine of claim 21, wherein said capillary bubble screen is a fine-mesh hydrophilic fiber material.

23. The turbine engine of claim 13 further including a resistive flow element before said output from said side-branch hotwell to provide resistance to liquid flow entering said inlet to said liquid ring pumping element.

24. The turbine engine of claim 14, wherein said resistive flow element is an orifice.

25. The method of improving a gas turbine engine comprising:

a. removing exit fluid from a condenser;

b. agitating the exit fluid to separate liquid from gas vapors;

c. sending said liquid to a feed pump;

d. sending said vapors along with any remaining liquid to a holding volume;

e. separating said remaining liquid from said vapors; and f. allowing said remaining liquid to enter with the removal of said exit flow from the condenser.

26. The method of claim 25, wherein agitating is performed using a impeller.

27. The method of claim 25, wherein said volume is a hotwell.

* * * * *